US008580080B2

(12) United States Patent
Nozaki et al.

(10) Patent No.: US 8,580,080 B2
(45) Date of Patent: Nov. 12, 2013

(54) PROCESS FOR PRODUCING BULKY PAPER WITH CONCAVO-CONVEX PATTERN

(75) Inventors: Satoshi Nozaki, Kanonji (JP); Tsutomu Shirai, Kanonji (JP)

(73) Assignee: Unicharm Corporation, Shikokuchuo-shi (JP)

( * ) Notice: Subject to any disclaimer, the term of this patent is extended or adjusted under 35 U.S.C. 154(b) by 101 days.

(21) Appl. No.: 12/994,107

(22) PCT Filed: Apr. 28, 2009

(86) PCT No.: PCT/JP2009/058719

§ 371 (c)(1), (2), (4) Date: Nov. 22, 2010

(87) PCT Pub. No.: WO2009/145043

PCT Pub. Date: Dec. 3, 2009

(65) Prior Publication Data

US 2011/0083819 A1 Apr. 14, 2011

(30) Foreign Application Priority Data

May 30, 2008 (JP) ..... 2008-143587

(51) Int. Cl.
*D21H 21/54* (2006.01)
*D21H 21/56* (2006.01)
*D21H 25/16* (2006.01)

(52) U.S. Cl.
USPC ..... 162/115; 162/109; 162/158; 162/164.1; 162/168.1; 162/207

(58) Field of Classification Search
USPC ..... 162/109, 115, 158, 164.1, 168.1, 204, 162/206–207; 34/372, 413–414, 424, 34/443–444, 448
See application file for complete search history.

(56) References Cited

U.S. PATENT DOCUMENTS 5,331,749 A * 7/1994 Thiele ..... 34/117
5,418,257 A * 5/1995 Weisman ..... 521/54

(Continued)

FOREIGN PATENT DOCUMENTS

JP 60007298 A * 1/1985
JP 60-59198 5/1985

(Continued)

OTHER PUBLICATIONS

JP Machine Translation of JP 2006-028654 published on Feb. 2, 2006.*

(Continued)

*Primary Examiner* — Jose A Fortuna
(74) *Attorney, Agent, or Firm* — Morrison & Foerster LLP

(57) ABSTRACT

The present invention relates to a process for producing a bulky paper with a concavo-convex pattern consisting of low density regions with a high degree of expansion of the heat-expanding particles and high density regions with a low degree of expansion of the heat-expanding particles, comprising: making a wet mixed sheet having heat-expanding particles uniformly dispersed in fibers from a paper-making material prepared by dispersing a fiber starting material and heat-expanding particles in water; then spraying prescribed sections of the wet mixed sheet with moist hot air or water vapor at above the initial expansion temperature of the heat-expanding particles to cause expansion of the heat-expanding particles at those sections; and then drying at a temperature at which the heat-expanding particles do not fully expand. The process allows free designing of concavo-convex sections on bulky papers.

8 Claims, 7 Drawing Sheets

(56) References Cited

U.S. PATENT DOCUMENTS

| | | | | |
|---|---|---|---|---|
| 6,207,020 | B1 * | 3/2001 | Anderson | 162/207 |
| 6,475,343 | B1 * | 11/2002 | Grabscheid et al. | 162/207 |
| 6,613,195 | B2 * | 9/2003 | Anderson | 162/289 |
| 6,846,529 | B2 * | 1/2005 | Mohan et al. | 428/34.2 |
| 7,335,279 | B2 * | 2/2008 | Mohan et al. | 162/135 |
| 7,513,975 | B2 * | 4/2009 | Burma | 162/263 |
| 7,553,535 | B2 | 6/2009 | Noda et al. | |
| 7,943,011 | B2 * | 5/2011 | Reed et al. | 162/202 |
| 7,976,523 | B2 | 7/2011 | Suzuki et al. | |
| 2001/0008181 | A1 * | 7/2001 | Anderson | 162/204 |
| 2003/0000673 | A1 * | 1/2003 | Anderson | 162/207 |
| 2005/0098284 | A1 * | 5/2005 | Heikkinen et al. | 162/135 |
| 2006/0057365 | A1 * | 3/2006 | Swoboda et al. | 428/323 |
| 2006/0058769 | A1 | 3/2006 | Suzuki et al. | |
| 2007/0215678 | A1 * | 9/2007 | Swoboda et al. | 229/5.81 |
| 2007/0256805 | A1 * | 11/2007 | Reed et al. | 162/164.1 |
| 2007/0298220 | A1 | 12/2007 | Noda et al. | |
| 2009/0149559 | A1 * | 6/2009 | Masuda et al. | 521/56 |
| 2010/0120929 | A1 * | 5/2010 | Naito et al. | 521/57 |
| 2011/0083819 | A1 * | 4/2011 | Nozaki et al. | 162/115 |
| 2011/0139385 | A1 * | 6/2011 | Nozaki et al. | 162/109 |

FOREIGN PATENT DOCUMENTS

| | | | | |
|---|---|---|---|---|
| JP | 2-264093 | | | 10/1990 |
| JP | 5-339898 | | | 12/1993 |
| JP | 07205543 | A | * | 8/1995 |
| JP | 09001974 | A | * | 1/1997 |
| JP | 10-88495 | | | 4/1998 |
| JP | 2000-34695 | | | 2/2000 |
| JP | 2001-98494 | | | 4/2001 |
| JP | 2005206988 | A | * | 8/2005 |
| JP | 2006-28654 | | | 2/2006 |
| JP | 2009235627 | A | * | 10/2009 |
| JP | 2009287150 | A | * | 12/2009 |
| JP | 2009287152 | A | * | 12/2009 |
| WO | WO 2008084372 | A1 | * | 7/2008 |
| WO | WO 2009145042 | A1 | * | 12/2009 |
| WO | WO 2009145043 | A1 | * | 12/2009 |

OTHER PUBLICATIONS

International Search Report mailed Jul. 14, 2009, directed towards Application No. PCT/JP2009/058719; 1 page.

First Notice of Reasons for Rejection mailed Feb. 16, 2012, directed to Chinese Application No. 200980120097.7; 16 pages.

First Notice of Reasons for Rejection mailed Feb. 16, 2012, directed to Chinese Application No. 200980120213.5; 13 pages.

Nozaki et al., Office Action mailed on Oct. 12, 2012, directed to U.S. Appl. No. 12/991,673; 5 pages.

International Search Report mailed Jul. 14, 2009, directed towards Application No. PCT/JP2009/058718; 2 pages.

Nozaki et al., Office Action dated Jun. 15, 2012, directed to U.S. Appl. No. 12/991,673; 7 pages.

* cited by examiner

PROCESS FOR PRODUCING BULKY PAPER WITH CONCAVO-CONVEX PATTERN

TECHNICAL FIELD

The present invention relates to bulky paper with a concavo-convex pattern, and to a process for producing thereof.

BACKGROUND ART

PTL 1, PTL 2 and PTL 3 disclose processes in which a wet mixed sheet obtained by making paper from a paper material containing uniformly mixed heat-expanding particles is dried and simultaneously expanded in a drying step, to obtain a homogeneous bulky paper with a density of 0.1-0.3 g/cm$^3$, and having no concavo-convex pattern. PTL 4 discloses a process for producing a sheet with a concavo-convex pattern obtained by thermal expansion of heat-expanding particles. Specifically, PTL 4 discloses anchoring heat-expanding particles in pulp and then aggregating them to form flock, dispersing the flock in a paper material containing no heat-expanding particles and making a paper, and then heating the obtained sheet to cause expansion of the heat-expanding particles to form a patterned sheet with a concavo-convex pattern wherein the flock-containing sections have become the expanded bulky sections.

CITATION LIST

Patent Literature

PTL 1 Japanese Unexamined Patent Publication HEI No. 5-339898

PTL 2 Japanese Unexamined Patent Publication HEI No. 10-88495

PTL 3 Japanese Unexamined Patent Publication No. 2000-34695

PTL 4 Japanese Unexamined Patent Publication SHO No. 60-59198

SUMMARY OF INVENTION

Technical Problem

In the processes disclosed in Japanese Unexamined Patent Publication HEI No. 5-339898, Japanese Unexamined Patent Publication HEI No. 10-88495 and Japanese Unexamined Patent Publication No. 2000-34695, the thermal expansion treatment is carried out simultaneously with drying so that the entire sheet is evenly heated, and therefore expansion of the heat-expanding particles takes place uniformly throughout the entire sheet, making it impossible to produce a concavo-convex pattern in the sheet. The process disclosed in Japanese Unexamined Patent Publication SHO No. 60-59198 yields bulky flock-containing sections, but since it is difficult to freely manipulate the positions of the flock, it is not possible to freely design the configuration of the concavo-convex pattern.

Solution to Problem

The process of the invention is a process for producing a bulky paper with a concavo-convex pattern consisting of low density regions with a high degree of expansion of the heat-expanding particles and high density regions with a low degree of expansion of the heat-expanding particles, comprising: making a wet mixed sheet having heat-expanding particles uniformly dispersed in fibers from a paper-making material prepared by dispersing a fiber starting material and heat-expanding particles in water; then spraying prescribed sections of the wet mixed sheet with moist hot air or water vapor at above the initial expansion temperature of the heat-expanding particles to cause expansion of the heat-expanding particles at those sections; and then drying at a temperature at which the heat-expanding particles do not fully expand.

According to a preferred embodiment, the invention is characterized in that the paper-making material comprises 1-40 parts by mass of heat-expanding particles having a mean particle size of 5-30 μm before expansion and expanding 20- to 125-fold by volume upon heating, with respect to 100 parts by mass of a fiber starting material composed of 30-100% by mass natural pulp and 0-70% by mass other fiber. According to other preferred embodiment, the invention is characterized in that the density of the low density regions is at least 0.01 g/cm$^3$ and less than 0.1 g/cm$^3$, and the density of the high density regions is at least 0.1 g/cm$^3$ and no greater than 0.3 g/cm$^3$. According to other preferred embodiment, the invention is characterized in that the wet mixed sheet is placed on a support and moist hot air or water vapor at above the initial expansion temperature of the heat-expanding particles is sprayed from the top side of the wet mixed sheet while suctioning the moist hot air or water vapor from the bottom side, to cause the moist hot air or water vapor to pass through the wet mixed sheet, thereby expanding the heat-expanding particles. According to other preferred embodiment, the invention is characterized in that a jet nozzle with the jet holes situated at a prescribed spacing in the cross-machine direction of the wet mixed sheet is used to spray the moist hot air or water vapor. According to other preferred embodiment, the invention is characterized in that a screen having openings in a prescribed pattern is placed on the top side of the wet mixed sheet and the moist hot air or water vapor is sprayed from the top side of the screen. According to other preferred embodiment, the invention is characterized in that the low density regions and high density regions are continuous lines in the machine direction, and are alternately arranged in the cross-machine direction of the wet mixed sheet to form a ridge-furrow design extending in the machine direction. According to other preferred embodiment, the invention is characterized in that the low density regions are interspersed within the high density regions.

The bulky paper with a concavo-convex pattern according to the invention is obtained by making a wet mixed sheet having heat-expanding particles uniformly dispersed in fibers from a paper-making material prepared by dispersing in water 100 parts by mass of a fiber starting material composed of 30-100% by mass natural pulp and 0-70% by mass other fiber, and 1-40 parts by mass of heat-expanding particles having a mean particle size of 5-30 μm before expansion and expanding 20- to 125-fold in volume when heated, subsequently spraying prescribed sections of the wet mixed sheet with moist hot air or water vapor at above the initial expansion temperature of the heat-expanding particles to cause expansion of the heat-expanding particles at those sections, and then drying at a temperature at which the heat-expanding particles do not fully expand, and it has a concavo-convex pattern composed of low density regions with a high degree of expansion of the heat-expanding particles and high density regions with a low degree of expansion of the heat-expanding particles.

Advantageous Effects of Invention

Since the process of the invention is a process in which a wet mixed sheet having heat-expanding particles uniformly dispersed in fibers is produced from a paper-making material prepared by dispersing a fiber starting material and heat-expanding particles in water, and then prescribed sections of the wet mixed sheet are sprayed with moist hot air or water vapor at above the initial expansion temperature of the heat-expanding particles to cause expansion of the heat-expanding particles at those sections, it allows free design of concavo-convex patterns. Also, since the basis weight of a bulky paper obtained by the process of the invention is uniform and the density differs between the concavo-convex sections, the sheet is characterized by having high fluid diffusion force at the high density sections which are concave, while having high fluid retention and high fluid migration properties at the low density sections which are convex. That is, the bulky paper of the invention exhibits behavior such that large amounts of fluid are instantaneously absorbed and retained at the convex sections, and then diffusion of the absorbed fluid into the concave sections results in migration of the fluid retained in the convex sections to the concave sections, thus reducing the fluid volume in the convex sections and restoring the fluid absorption power. Conventionally, low density sheets such as airlaid pulp nonwoven fabrics which have high fluid retention but poor diffusibility (for example, low density sheets with a density of about 0.03 g/cm$^3$) have been utilized as materials for absorption cores in absorbent articles because of their bulk properties and fluid retaining properties, whereas high density sheets with excellent fluid diffusion but poor fluid retention (for example, high density sheets with a density of about 0.3 g/cm$^3$) have been used as diffusion sheets in absorption cores of absorbent articles because of their high fluid diffusibility. The bulky paper of the invention may be considered to exhibit both of the mutually contradictory properties of low density sheets and high density sheets. While it has been possible in the prior art to obtain a sheet satisfying these mutually contradictory properties simply by attaching together a low density sheet and a high density sheet, the process of the invention achieves the same in a more simple and economical manner.

Because the convex sections of the bulky paper of the invention are bulky with a structure in which heat-expanding particles are present between fibers, not only is the bulk maintained when wet, but repulsion elasticity is also exhibited against pressure. Therefore, when the sheet is used as the absorption core of an absorbent article such as a paper diaper or sanitary product, the product undergoes minimal twisting.

DESCRIPTION OF EMBODIMENT

Figure 1:
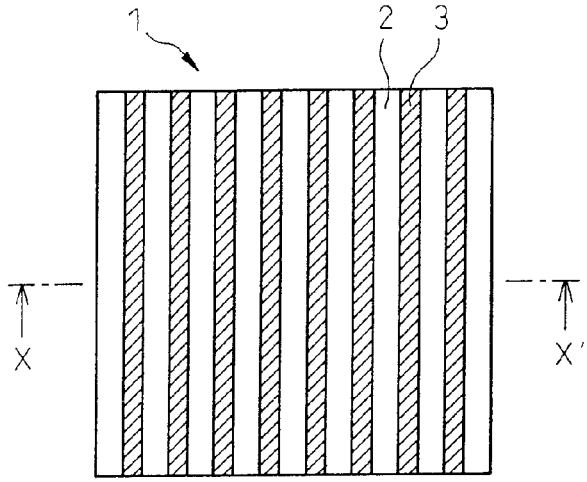
FIG. 1 is a plan view of an embodiment of a bulky paper with a concavo-convex pattern according to the invention.

The invention will now be described in greater detail with reference to the accompanying drawings, with the understanding that the invention is not limited to the examples depicted in the drawings.

Figure 2:
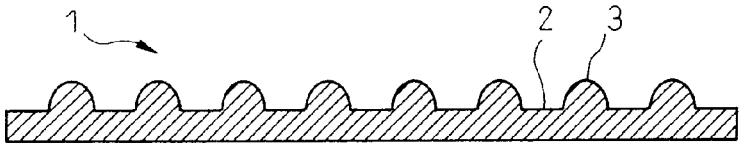
FIG. 2 is a cross-sectional view of an embodiment of a bulky paper with a concavo-convex pattern according to the invention.

FIG. 1 is a plan view of an embodiment of a bulky paper 1 with a concavo-convex pattern according to the invention, and FIG. 2 is a cross-sectional view along line X-X'. The bulky paper 1 with a concavo-convex pattern according to the invention is composed of high density regions 2 and low density regions 3.

Figure 3:
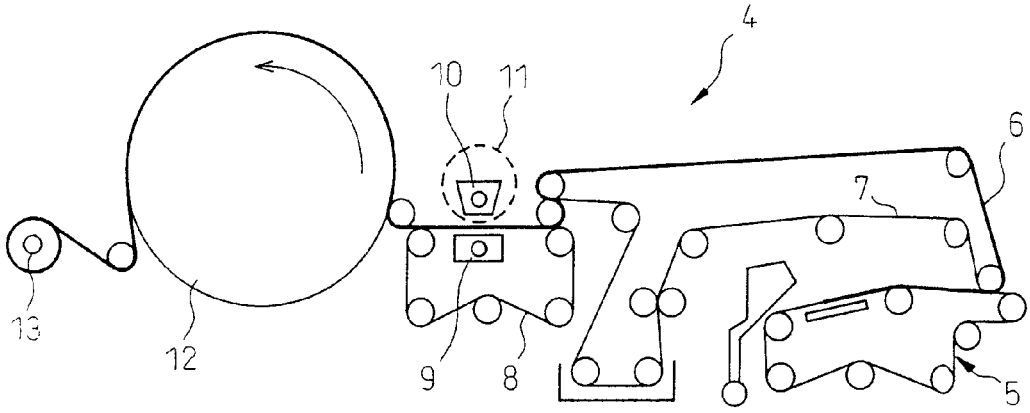
FIG. 3 is a simplified view of a paper machine depicted as being used in continuous production.

FIG. 3 is a simplified view of a paper machine 4 used in the production process of the invention. The paper machine 4 comprises a paper-making part 5, a wet mixed sheet 6, a first conveyor belt 7, a second conveyor belt 8, a suction box 9, a jet nozzle 10, a screen 11, a dryer 12 and a finished product take-up roll 13. The paper-making part 5 is used to produce the wet mixed sheet 6 from a paper-making material liquid obtained by dispersing a fiber starting material and heat-expanding particles in water, wherein the wet mixed sheet 6 is conveyed by the first conveyor belt 7 and second conveyor belt 8, the wet mixed sheet 6 is subsequently heated by moist hot air or water vapor from the jet nozzle 10 to cause expansion of the heat-expanding particles, the sheet is then dried with the dryer 12, and the finished bulky paper is taken up with the finished product take-up roll 13 to obtain a bulky paper with a concavo-convex pattern.

Figure 4:
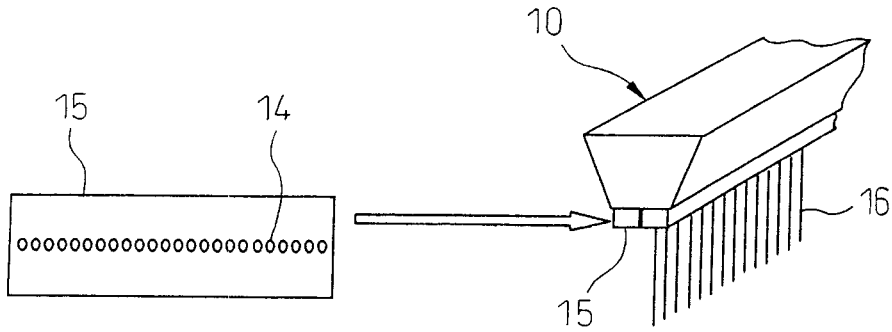
FIG. 4 is a plan view of a nozzle plate comprising jet holes and an oblique view of the jet nozzle incorporating it.

FIG. 4 shows a plan view of a nozzle plate 15 comprising jet holes 14 and an oblique view of the jet nozzle 10 incorporating it. Using the nozzle plate 15 shown in FIG. 4 produces a columnar jet 16.

Figure 5:
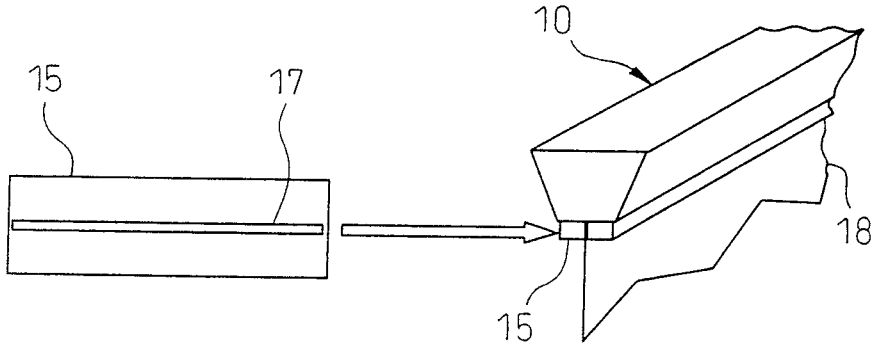
FIG. 5 is a plan view of a nozzle plate comprising a spray slit and an oblique view of the jet nozzle incorporating it.

FIG. 5 shows a plan view of a nozzle plate 15 comprising a spray slit 17 and an oblique view of the jet nozzle 10 incorporating it. Using the nozzle plate 15 shown in FIG. 5 produces a curtain jet 18.

Figure 6:
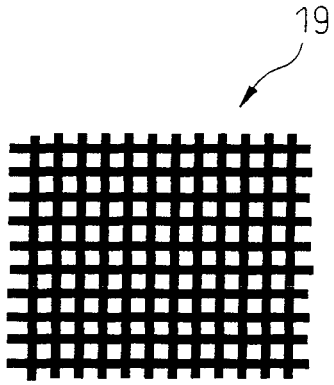
FIG. 6 is a plan view of a flat screen.
Figure 7:
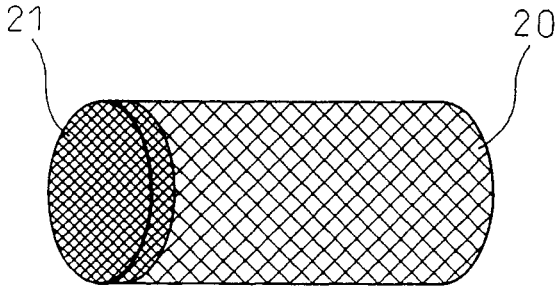
FIG. 7 is an oblique view of a drum-shaped screen and a drum-shaped wire mesh.

A screen may be layered over the top of the wet mixed sheet when moist hot air or water vapor is sprayed onto the wet mixed sheet. When a screen is provided, the obtained bulky paper will exhibit a concavo-convex pattern with the low density regions interspersed within the high density regions. FIG. 6 is a plan view of a flat screen 19. FIG. 7 is an oblique view of a drum-shaped screen 20 and a drum-shaped wire mesh 21. The drum-shaped wire mesh 21 is provided inside the drum-shaped screen 20. The flat screen 19 and drum-shaped screen 20 may have opening dimensions of 5×5 mm and rib widths of 2 mm.

Figure 8:
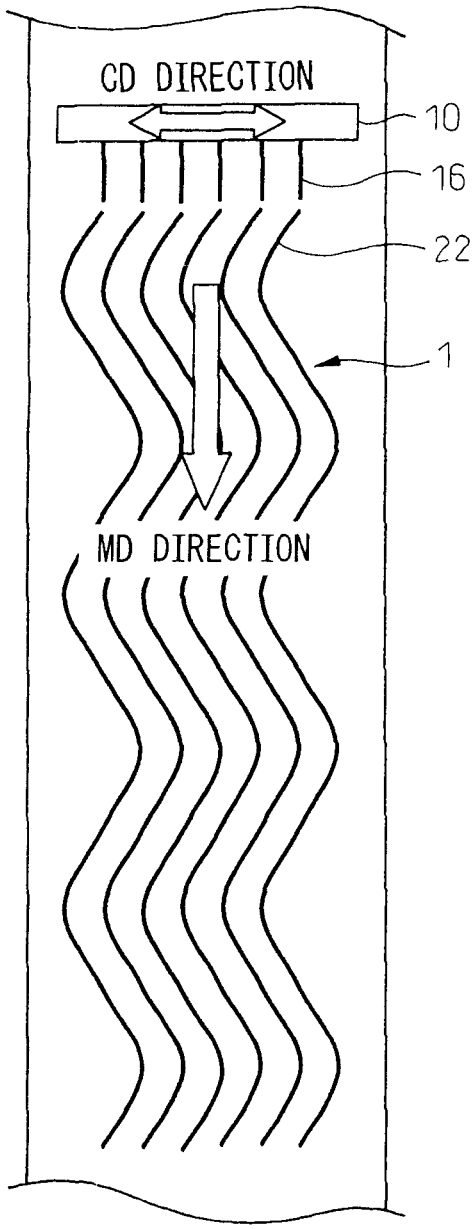
FIG. 8 shows wavy lines created by reciprocal movement of the jet nozzle in the CD direction.
Figure 9:
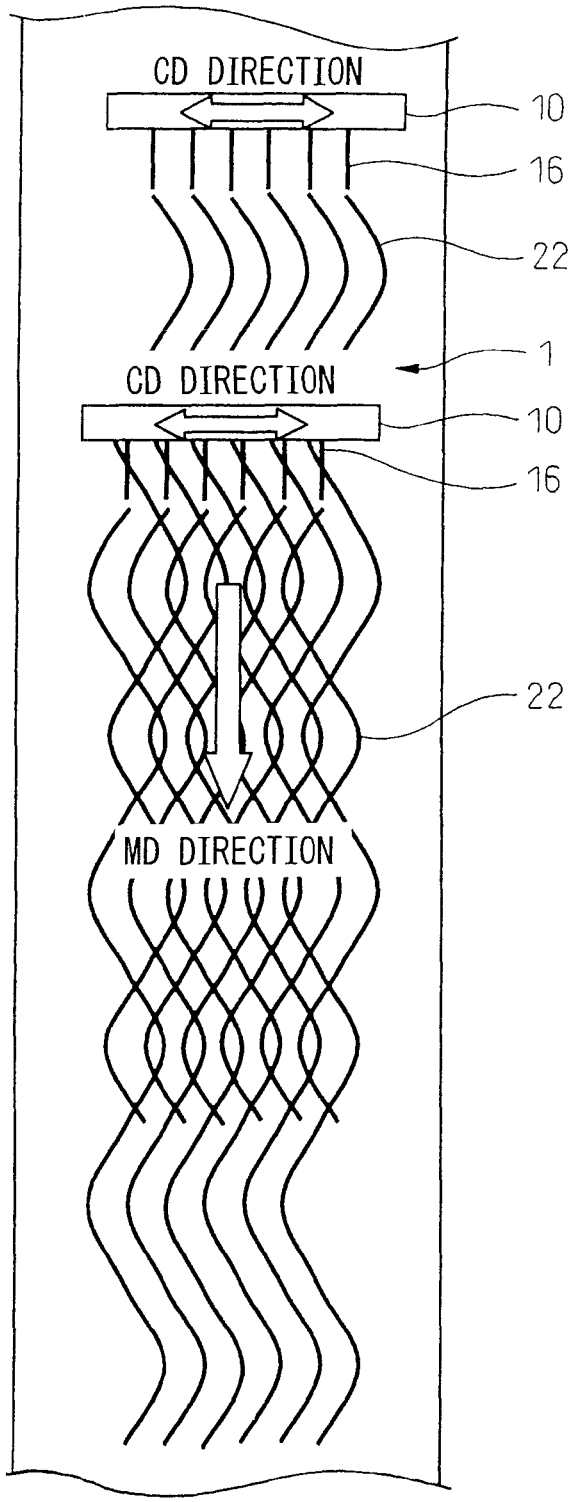
FIG. 9 shows wavy lines created by reciprocal movement of multiple jet nozzles in the CD direction.

When the jet nozzle 10 shown in FIG. 4 is used to spray moist hot air or water vapor onto a wet mixed sheet by a columnar jet 16, reciprocal movement of the jet nozzle 10 in the cross-machine direction (CD direction) of the wet mixed sheet 1 creates a concavo-convex pattern of wavy lines 22 extending in the machine direction (MD direction), as shown in FIG. 8. If multiple jet nozzles 10 are provided as shown in FIG. 9, it is possible to form an interlaced pattern with crossed wavy lines 22. The pitch and heights of the waves are determined by the number of strokes (per minute) of the jet nozzle in the CD direction and the running speed (m/min) of the sheet in the MD direction. If multiple jet nozzles are provided, various different patterns can be produced by altering the stroke distance and cycle for each of the jet nozzles.

The fiber starting material used for the invention may be any one ordinarily used for paper making, and examples include natural pulp, synthetic pulp, organic fiber and inorganic fiber. For example, the fiber starting material may consist of 30-100% by mass natural pulp and 0-70% by mass fiber selected from the group consisting of synthetic pulp, organic fiber and inorganic fiber. From the viewpoint of paper making properties, a pulp content of 50% by mass or greater will result in superior sheet formation and strength. Natural pulp, synthetic pulp, organic fiber and inorganic fiber may be any types commonly used for paper making. Natural pulp may be, for example, wood pulp such as chemical pulp or mechanical pulp from a conifer or broadleaf tree, waste paper pulp, or nonwood natural pulp such as hemp or cotton, although there is no restriction to these. As synthetic pulp there may be mentioned synthetic pulp obtained from polyethylene or polypropylene starting materials, although there is no limitation to these. As organic fiber there may be mentioned acrylic fiber, rayon fiber, phenol fiber, polyamide fiber and polyethylene fiber, with no limitation to these. As inorganic fiber there may be mentioned glass fiber, carbon fiber, alumina fiber and the like, with no limitation to these.

The heat-expanding particles used for the invention are heat-expanding microcapsules obtained by encapsulating a low boiling point solvent in microcapsules. The heat-expanding particles are particles with a mean particle size of 5-30 μm and preferably 8-14 μm before expansion, which expand 20- to 125-fold and preferably 50- to 80-fold by volume upon brief heating at a relatively low temperature of 80-200° C. The heat-expanding particles are obtained by encapsulating a volatile organic solvent (expanding agent) such as isobutane, pentane, petroleum ether, hexane, a low-boiling-point halogenated hydrocarbon or methylsilane as the low-boiling-point solvent, with a thermoplastic resin composed of a copolymer such as vinylidene chloride, acrylonitrile, an acrylic acid ester, a methacrylic acid ester or the like, and upon heating at above the softening point of the film polymer of the heat-expanding particles, the film polymer begins to soften causing the vapor pressure of the encapsulated expanding agent to increase simultaneously, so that the film is pushed outward to cause expansion of the capsules. The heat-expanding particles expand at relatively low temperature and in a short period of time to form closed cells, thus providing a material with excellent thermal insulation properties, which is also relatively manageable and suitable for the present purpose. As such heat-expanding particles there are known Matsumoto Microsphere F-36, F-30D, F-30GS, F-20D, F-50D and F-80D (product of Matsumoto Yushi-Seiyaku Co., Ltd.) and EXPANCEL WU and DU (product of Sweden, marketed by Japan Fillite Co., Ltd.), although there is no limitation to these. The heat-expanding particle content is 1-40 parts by mass and preferably 3-20 parts by mass with respect to 100 parts by mass of the pulp fiber, because at less than 1 part by mass the expansion will not be sufficient, while economical disadvantages are presented at greater than 40 parts by mass.

The pulp slurry may further contain various anionic, nonionic, cationic or amphoteric yield improvers, paper strength additives, sizing agents and the like, selected as appropriate. Specifically, as paper strength additives and yield improvers there may be used combinations of organic compounds such as polyacrylamide-based cationic, nonionic, anionic and amphoteric resins, polyethyleneimine and its derivatives, polyethylene oxide, polyamines, polyamides, polyamide-polyamine and its derivatives, cationic and amphoteric starch, oxidized starch, carboxymethylated starch, vegetable gum, polyvinyl alcohol, urea-formalin resin, melamine-formalin resin and hydrophilic polymer particles, and inorganic compounds including aluminum compounds such as aluminum sulfate, alumina sol, basic aluminum sulfate, basic aluminum chloride and basic polyaluminum hydroxide, and iron(II) sulfate, iron(II) chloride, colloidal silica, bentonite or the like.

In the process of the invention, the starting slurry obtained by mixing within water in the prescribed proportions is sheeted with a paper-making wire part and then dewatered with a press part. In an ordinary paper-making process the moisture content is brought to about 60% by mass of the paper-making material by dewatering, but according to the invention, moist hot air or water vapor is partially sprayed onto the wet mixed sheet containing the heat-expanding particles to cause expansion of the heat-expanding particles at the sprayed sections, and therefore if the moisture content of the wet mixed sheet is too low the heat will rapidly circulate to the non-sprayed sections, tending to result in expansion of the particles at those sections and hence less difference in the expansion. A higher moisture content of the wet mixed sheet is therefore preferred for thermal expansion, although an excessively high moisture content is uneconomical because it requires extra sprayed vapor. The moisture content of the wet mixed sheet is preferably about 60-100% by mass, although the suitability limits cannot be clearly defined.

The dewatered wet mixed sheet is then sent to the thermal expansion step, where the dewatered sheet is heated with moist hot air or water vapor at a prescribed temperature to cause expansion of the heat-expanding particles. If the sheet is placed on a support and suction is applied from the bottom of the support while spraying moist hot air or water vapor from the top side, the entire sheet will be heated rapidly and evenly, thereby increasing the thermal expansion effect, and therefore this method may be considered to be most efficient. The support may be, but is not limited to, a net or other type of conveyor belt. When the moist hot air or water vapor is directly sprayed onto the wet mixed sheet from a jet nozzle with jet holes at a prescribed spacing, continuous heated lines and non-heated lines will be formed in the MD direction. This will result in expanded lines and non-expanded lines, so that a ridge-furrow concavo-convex pattern can be obtained. The degree of expansion can be controlled to some extent by the vapor spraying volume and temperature, but excessive spraying will cause the heat to circulate to the non-sprayed sections, resulting in their expansion as well. When the moist hot air or water vapor is directly sprayed onto the wet mixed sheet from a jet nozzle, powerful moist hot air or water vapor force may blow off the fibers of the wet mixed sheet where the moist hot air or water vapor contacts. However, placing a wire mesh between the wet mixed sheet and jet nozzle can eliminate the problem of fiber blow-off since the moist hot air or water vapor will be converted from a column into a spray. The wire mesh may be a 90 mesh wire mesh, for example.

Another method for forming heated sections and non-heated sections involves layering a screen with a prescribed pattern of holes on the wet mixed sheet, and spraying moist hot air or water vapor through the screen. In this method, the moist hot air or water vapor is preferably sprayed evenly across the entire sheet surface rather than as a spaced columnar jet, as explained above. The method for even spraying over the entire sheet surface may be one wherein a curtain jet is sprayed using a jet nozzle with a spray slit. When a columnar jet is used, the spacing between jet holes of the jet nozzle is preferably as small as possible. Since the moist hot air or water vapor will not contact the wet mixed sheet under the non-open sections of the screen, the heat-expanding particles will not expand at those sections, whereas the heat-expanding particles will expand under the openings of the screen where the moist hot air or water vapor contacts the wet mixed sheet. This method allows free design of patterns while also permitting adjustment of the degree of expansion, similar to the method described above.

The wet mixed sheet that has been thermally expanded is then sent to a drying step for drying. Although an ordinary drying method of the prior art may be used for drying, it is essential to avoid crushing the sheet with a strong press.

The temperature of the moist hot air or water vapor used for the invention may be above the temperature at which the microcapsule shell walls of the heat-expanding particles soften and begin to expand, and it will be determined by the heat-expanding particles used. The relative humidity is preferably 100% by mass in order to prevent drying of the wet mixed sheet during the thermal expansion step, but it does not necessarily need to be 100% by mass. The method of supplying the moist hot air or water vapor is most preferably a method in which high-temperature steam from a boiler is ejected and directly sprayed onto the sheet, but moist exhaust from the drier may also be used.

The density at low density regions of the bulky paper of the invention is at least 0.01 g/cm$^3$ and less than 0.1 g/cm$^3$, and preferably at least 0.01 g/cm$^3$ and no greater than 0.05 g/cm$^3$, while the density at the high density regions is at least 0.1 g/cm$^3$ and no greater than 0.3 g/cm$^3$. If the density at the low density regions of the bulky paper of the invention is 0.1 g/cm$^3$ or greater the fluid retention property will be reduced, while if it is less than 0.01 g/cm$^3$ the strength will be reduced and tearing will easily occur, tending to cause problems with surface friction durability and resulting in poor practical utility. If the density at the high density regions of the bulky paper of the invention is less than 0.1 g/cm$^3$, the fluid diffusibility will be inferior. From the viewpoint of fluid diffusibility, therefore, a higher density is preferred at the high density regions; however, if the density is 0.3 g/cm$^3$ or greater the fluid diffusibility will tend to remain low, and therefore the density at the high density regions is preferably no greater than 0.3 g/cm$^3$. Uses of the bulky paper of the invention include paper diapers and sanitary napkins, as well as cut packaging sheets, packing cushion sheets, wiping sheets and the like.

EXAMPLE

The present invention will be explained in greater detail by examples, with the understanding that the invention is in no way limited by the Examples.

Example 1

Figure 10:
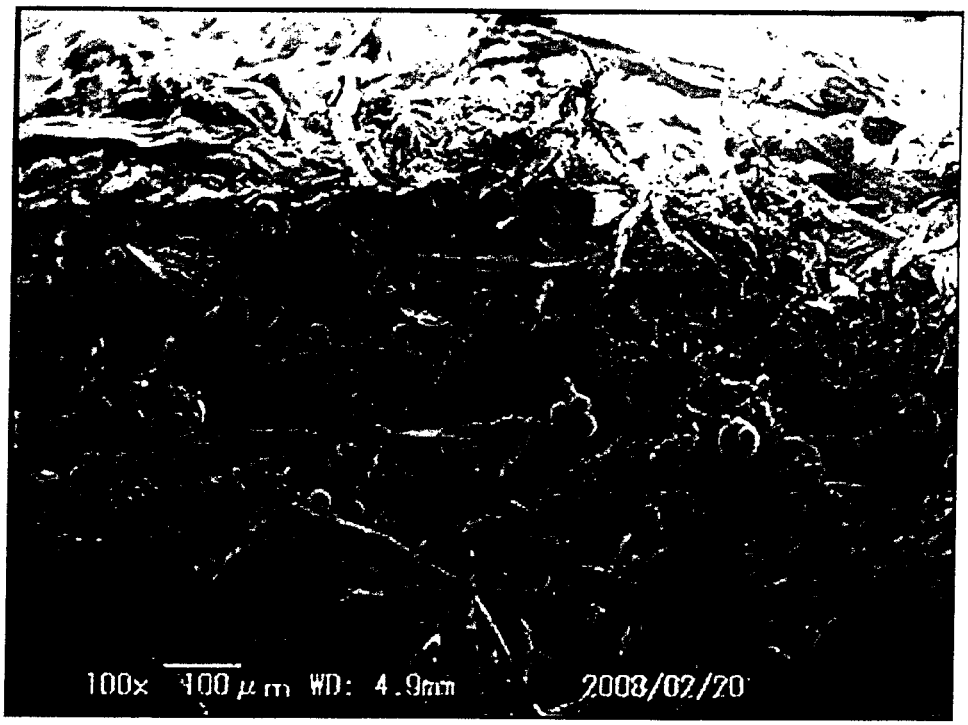
FIG. 10 is a cross-sectional photograph of the low density ridge sections of the bulky paper obtained in Example 1.
Figure 11:
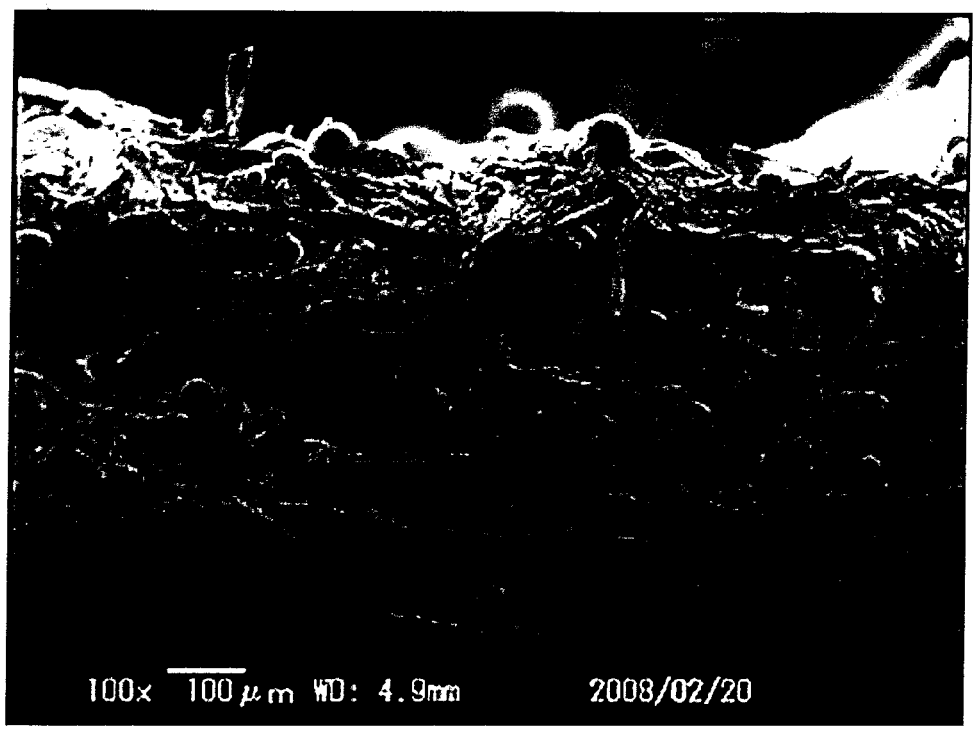
FIG. 11 is a cross-sectional photograph of the high density furrow sections of the bulky paper obtained in Example 1.

To a pulp slurry obtained by dispersing 85 parts by mass of conifer bleached Kraft pulp in water there were added 15 parts by mass of Matsumoto Microsphere F-36 (product of Matsumoto Yushi-Seiyaku Co., Ltd., particle size: 5-15 μm, initial expansion temperature: 75-85° C.) as heat-expanding particles, 0.2 part by mass of FILEX RC-104 (product of Meisei Chemical Works, Ltd., cation-modified acrylic copolymer) as a heat-expanding particle anchoring agent and 0.2 part by mass of FILEX M (product of Meisei Chemical Works, Ltd., acrylic copolymer) while stirring, to obtain a paper-making material with a pulp concentration of 1.0% by mass. The obtained paper-making material was used to make paper with a basis weight of 50 g/m$^2$ using a rectilinear hand-sheet machine according to a common method, and the paper was dewatered by sandwiching between filter sheets to obtain a wet mixed sheet with a moisture content of 90% by mass. The screened wet mixed sheet was placed on a conveyor belt and conveyed at a speed of 5 m/min while applying suction from the bottom of the conveyor belt and blowing water vapor obtained from a boiler (nozzle manifold internal temperature: 172-174° C., pressure: 0.82-0.85 MPa) onto the top of the wet mixed sheet using a jet nozzle (hole diameter: 0.4 mm, hole pitch: 3 mm, single row arrangement) as shown in FIG. 4, to cause expansion of the sheet. Next, the sheet was dried with a rotary dryer set to 120° C., without applying strong pressure thereto, to obtain a bulky paper with a basis weight of 50 g/m$^2$. The obtained sheet had a ridge-furrow concavo-convex pattern with low density regions and high density regions as continuous lines in the MD direction, alternately arranged in the CD direction, wherein the ridges had a thickness of 1.2 mm and a density of 0.04 g/cm$^3$ while the furrows had a thickness of 0.4 mm and a density of 0.125 g/cm$^3$. A cross-section of the obtained sheet was observed with an electron microscope. FIG. 10 shows a cross-sectional photograph of the low density ridge sections of the obtained bulky paper, and FIG. 11 shows a cross-sectional photograph of the high density furrow sections of the obtained bulky paper. As seen in FIG. 10 and FIG. 11, more expanded particles are visible throughout the low density ridge sections than in the furrow sections, with greater expansion of the distance between pulp fibers in both the upper layer/lower layer of the sheet, while no expansion bias was observed in the thickness direction. In the high density furrows, there were fewer expanded particles overall, and the expanded particles were biased toward the water vapor spraying surface in the direction of thickness while more unexpanded particles remained on the opposite surface.

Example 2

A sheet with a basis weight of 50 g/m$^2$ was obtained under the same conditions as Example 1, except that during the procedure of Example 1, the screen shown in FIG. 6 (opening dimensions: 5×5 mm, rib width: 2 mm) was placed on the wet mixed sheet and 90 mesh wire mesh was further placed thereover, and the water vapor was sprayed through them using a jet nozzle with a hole diameter of 0.2 mm and a hole pitch of 1 mm. The obtained sheet had a concavo-convex pattern with low density regions interspersed within continuous high density regions, wherein the high density regions had a thickness of 0.45 mm and a density of 0.111 g/cm$^3$, and the low density regions had a thickness of 1.4 mm and a density of 0.036 g/cm$^3$. Observation of a cross-section of the sheet with an electron microscope showed similar results as in Example 1.

Comparative Example 1

A sheet with a basis weight of 50 g/m$^2$ was obtained under the same conditions as Example 2, except that no screen was used during the procedure of Example 2. The thickness of the obtained bulky paper was roughly uniform across the entire surface, the thickness being 1.6 mm and the density being 0.031 g/cm$^3$. Observation of a cross-section of the sheet with an electron microscope showed similar ridge sections as in Example 1.

REFERENCES SIGNS LIST

1 Bulky paper
2 High density region
3 Low density region
4 Paper machine
5 Paper-making part
6 Wet mixed sheet

7 First conveyor belt
8 Second conveyor belt
9 Suction box
10 Spray nozzle
11 Screen
12 Dryer
13 Finished product take-up roll
14 Jet hole
15 Nozzle plate
16 Columnar jet
17 Spray slit
18 Curtain jet
19 Flat screen
20 Drum-shaped screen
21 Drum-shaped wire mesh
22 Wavy line

The invention claimed is:

1. A process for producing a bulky paper with a concavo-convex pattern comprising low density regions with a high degree of expansion of heat-expanding particles and high density regions with a low degree of expansion of heat-expanding particles comprising:

making a wet mixed sheet having heat-expanding particles uniformly dispersed in fibers from a paper-making material prepared by dispersing a fiber starting material and heat-expanding particles in water; then spraying prescribed sections of the wet mixed sheet with moist hot air or water vapor at above the initial expansion temperature of the heat-expanding particles to cause expansion of the heat-expanding particles at those sections; and then drying at a temperature at which the heat-expanding particles do not fully expand.

2. The process according to claim 1, wherein the paper-making material comprises 1-40 parts by mass of heat-expanding particles having a mean particle size of 5-30 μm before expansion and expanding 20- to 125-fold by volume upon heating, with respect to 100 parts by mass of a fiber starting material composed of 30-100% by mass natural pulp and 0-70% by mass other fiber.

3. The process according to claim 1, wherein the density of the low density regions is at least 0.01 g/cm$^3$ and less than 0.1 g/cm$^3$, and the density of the high density regions is at least 0.1 g/cm$^3$ and no greater than 0.3 g/cm$^3$.

4. The process according to claim 1, wherein the wet mixed sheet is placed on a support and moist hot air or water vapor at above the initial expansion temperature of the heat-expanding particles is sprayed from the top side of the wet mixed sheet while suctioning the moist hot air or water vapor from the bottom side, to cause the moist hot air or water vapor to pass through the wet mixed sheet, thereby expanding the heat-expanding particles.

5. The process according to claim 1, wherein a jet nozzle with the jet holes situated at a prescribed spacing in the cross-machine direction of the wet mixed sheet is used to spray the moist hot air or water vapor.

6. The process according to claim 1, wherein a screen having openings in a prescribed pattern is situated on the top side of the wet mixed sheet and the moist hot air or water vapor is sprayed from the top side of the screen.

7. The process according to claim 1, wherein the low density regions and high density regions are continuous lines in the machine direction, and are alternately arranged in the cross-machine direction of the wet mixed sheet to form a ridge-furrow design extending in the machine direction.

8. The process according to claim 1, wherein the low density regions are interspersed within the high density regions.

* * * * *